US007303515B2

(12) United States Patent
Wall

(10) Patent No.: US 7,303,515 B2
(45) Date of Patent: Dec. 4, 2007

(54) EXERCISE APPARATUS AND METHOD

(76) Inventor: Christopher P. Wall, 924 E. Lyon St., Milwaukee, WI (US) 53202

( * ) Notice: Subject to any disclaimer, the term of this patent is extended or adjusted under 35 U.S.C. 154(b) by 835 days.

(21) Appl. No.: 10/213,231

(22) Filed: Aug. 6, 2002

(65) Prior Publication Data

US 2004/0029685 A1 Feb. 12, 2004

(51) Int. Cl.
*A62B 26/00* (2006.01)
*A62B 71/00* (2006.01)

(52) U.S. Cl. ..... 482/141; 482/62; 273/108.1

(58) Field of Classification Search ..... 482/62, 482/71, 132, 72, 142, 148, 91, 907, 140; 472/116, 118, 88; D21/818; 273/108.1; 434/405; 108/65
See application file for complete search history.

(56) References Cited

U.S. PATENT DOCUMENTS

| | | | | |
|---|---|---|---|---|
| 3,101,944 | A * | 8/1963 | Cencig | 482/51 |
| 3,797,824 | A | 3/1974 | Osbourne | 272/57 |
| 3,907,294 | A * | 9/1975 | Breslow | 273/108.1 |
| 4,171,805 | A | 10/1979 | Abbott | 272/127 |
| 4,241,915 | A | 12/1980 | Noble et al. | 272/144 |
| 4,781,372 | A * | 11/1988 | McCormack | 482/70 |
| 4,898,382 | A * | 2/1990 | Lamanna | 273/442 |
| 4,930,769 | A | 6/1990 | Nenoff | 272/120 |
| 5,037,085 | A * | 8/1991 | Wexler | 482/148 |
| 5,114,387 | A * | 5/1992 | Keppler | 482/51 |
| 5,447,483 | A | 9/1995 | Liang | 482/132 |
| 5,468,199 | A * | 11/1995 | Keeler et al. | 482/35 |
| 5,499,961 | A | 3/1996 | Mattox | 482/132 |
| 5,518,483 | A | 5/1996 | Oswald | 482/131 |
| 5,643,162 | A * | 7/1997 | Landers et al. | 482/131 |
| 5,921,901 | A | 7/1999 | Palacios | 482/132 |
| 6,348,028 | B1 * | 2/2002 | Cragg | 482/148 |
| 6,440,045 | B1 * | 8/2002 | Gaston | 482/140 |

* cited by examiner

*Primary Examiner*—Lori Amerson
(74) *Attorney, Agent, or Firm*—Boyle Fredrickson Newholm Stein & Gratz S.C.

(57) ABSTRACT

An exercise apparatus includes a support defining a first sliding surface and at least one hand-held sliding device that defines that defines a second sliding surface. The hand-held sliding device, and particularly the second sliding surface, is configured to mate with the first sliding surface. In operation, the second sliding surface slides along the first sliding surface when a user applies body weight to the hand-held sliding device. The exercise apparatus preferably includes a stop coupled to the support which is positioned orthogonally to a sliding direction of the hand-held sliding device. The stop is preferably also adjustable, as is the support, to accommodate performing different types of exercises.

22 Claims, 7 Drawing Sheets

EXERCISE APPARATUS AND METHOD

BACKGROUND OF THE INVENTION

1. Field of the Invention

The invention is directed to exercise equipment, and more particularly, weightless exercise equipment that employs sliding surfaces and the user's own body weight to create the work required to perform a total body workout.

2. Description of Related Art

In many types of conventional muscle development techniques, equipment such as springs or weights is employed to provide extra strain on the muscles. Such equipment comes in many shapes and forms, varying over a wide range in terms of equipment complexity and cost. One characteristic of all such equipment, however, is that when operated the user's muscles are required to provide more force than they do normally when performing the same body motion. Weightlifting, with free weights or otherwise, is a common example.

In other exercise techniques, the extra weight or force is provided by the weight of the exercising person's own body, and thus such techniques are particularly suited for home exercise. An example of such an exercise is a standard "push-up" where the user uses his or her own body weight to increase the force needed to contract the target muscles and perform the movement. Alternatively, equipment may be provided to maximize the work required by the user in "lifting" her body weight. For example, one popular exercise is the "dip" where the user suspends her body from parallel bars, displaced from the ground and supported thereby, while raising and lowering her body. Such exercises are limited in terms of providing a complete body workout.

In this regard, independent of how the extra force required to perform a movement is introduced to the system, many types of exercise equipment attempt to provide a complete body workout. For example, the aforementioned free weights can be used to achieve a complete body workout by providing equipment that accommodates varying weights and lifting positions, for example. However, portability is compromised by requiring equipment that is relatively bulky. In addition, free weights can be dangerous and are best used with a workout partner.

Other systems overcome these drawbacks associated with free weights and afford better portability by providing relatively simple machines where the user's body weight is used to achieve a total body workout. One notable machine includes a track system where handles are mated to a track via wheels that roll along the track as the user works against a force created by the user's own body weight. However, such a system suffers significant drawbacks. For example, this machine is expensive to manufacture and, with its moving parts (e.g., the wheels), maintenance, and thus its useful life, ultimately becomes an issue. Moreover, in this regard, the machine is always at risk of experiencing down time, which is very inconvenient for the user. And, the machine is heavy, difficult to store and not easily transportable while not being particularly flexible in that it is not easily adaptable to persons of different sizes, shapes and skill levels.

As a result, the field of exercise equipment was in need of a system that takes advantage of the user's own body weight without requiring complex or expensive machines that may require significant maintenance. Such a system should preferably be lightweight, transportable, adjustable and easy to store. In addition, the system should allow the user to work different muscle groups with ready adjustments to provide a total body workout. And, minimum athletic ability and coordination should be required to perform the corresponding exercises.

SUMMARY OF THE INVENTION

The preferred embodiment overcomes the drawbacks of the prior art by providing a system in which the user's body weight is exploited in movements performed using a minimum of equipment having no moving parts. Rather, user movement is facilitated by appropriately defined sliding surfaces that are lightweight, transportable, fully adjustable and easy to store. The elegant design of the preferred embodiment also requires virtually no maintenance, thus enabling a long life span, while being extremely inexpensive to produce.

According to a first aspect of the preferred embodiment, an exercise apparatus includes a support defining a first sliding surface and at least one hand-held sliding device that defines a second sliding surface. The hand-held sliding device, and particularly the second sliding surface, is configured to mate with the first sliding surface. In operation, the second sliding surface slides along the first sliding surface when a user applies body weight to the hand-held sliding device.

According to another aspect of the preferred embodiment, the exercise apparatus includes a stop coupled to the support. The stop is positioned orthogonally to a sliding direction of the hand-held sliding device and is adjustable.

According to yet another aspect of the preferred embodiment, the support of the exercise apparatus defines left and right first sliding surfaces adapted to interface with first and second hand-held sliding devices. The left and right first sliding surfaces are elongated and have first and second opposed ends. At least one of the first and second opposed ends of the left first sliding surface are coupled to at least one of the first and second opposed ends of the right first sliding surface. The exercise apparatus has first and second connection devices that are used to couple the ends. A position of the support relative to one of the first and second connection devices is adjustable so as to adjust a sliding angle, and thus allow the user to work different muscles or muscle groups.

In another aspect of the preferred embodiment, an exercise apparatus supported by a first sliding surface includes at least one hand-held sliding device defining a second sliding surface configured to mate with the first sliding surface. The second sliding surface slides along the first sliding surface when a user applies body weight on the hand-held sliding device.

According to a further aspect of the present invention, a method of exercising includes providing a support defining a first sliding surface and a hand-held device which defines a second sliding surface that is adapted to mate with the first sliding surface. The hand-held sliding device is placed on the support and, by applying bodyweight on the hand-held sliding device, the second sliding surface slides relative to the first sliding surface.

According to yet another aspect of the present invention, the method further includes adjusting a position of the support relative to the torso of the user such that the user works a different muscle group during operation.

These and other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

Figure 1:
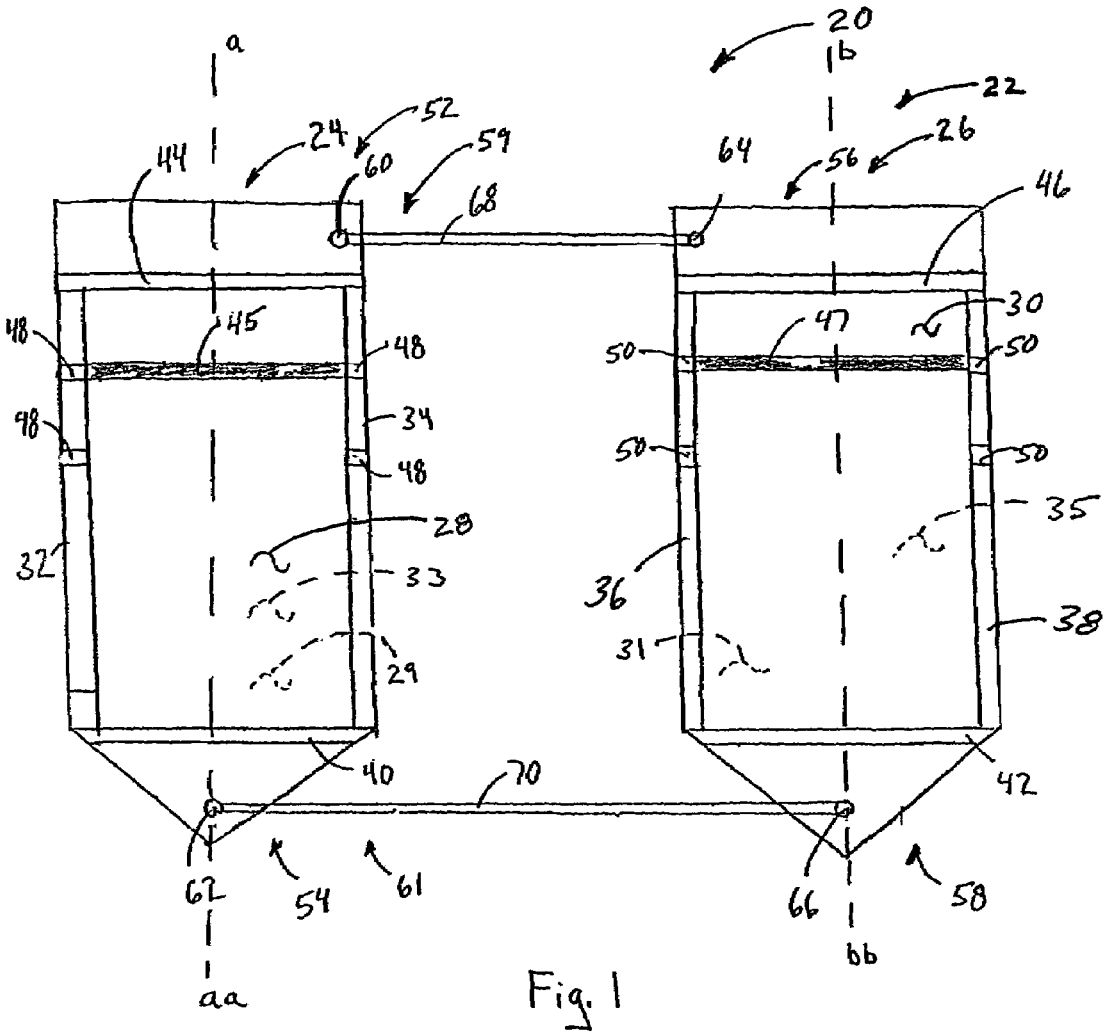
FIG. 1 is a top plan view of the base of the exercise apparatus of the present invention.

Turning initially to FIG. 1, an exercise apparatus 20 includes a base 22 that is adapted to receive at least one hand-held sliding device (e.g., 80 in FIG. 2) that the user manipulates to create stress on the user's muscles during a predetermined motion. Base 22 includes first and second base portions 24, 26. Base portions 24, 26 are adapted to receive hand-held sliding devices (see, e.g., FIG. 2), typically associated with the left and right hands of the user. First and second base portions define first and second sliding surfaces 28, 30, respectively, that allow the user holding the sliding devices to perform the motion by effectuating sliding movement between the two.

The sliding surfaces 28, 30 of base elements 24, 26 may be defined by generally parallel vertically extending walls 32, 34 and 36, 38 respectively, that operate to guide the hand-held devices during an exercise. Each of base portions 24, 26, respectively, includes a neutral position stop 40, 42 and a fixed positive or extended position stop 44, 46 that define a limit of the user's range of motion during exercise. Additional adjustable stops 45, 47 (e.g., adjustable bars) corresponding to base portions 24, 26 may be provided to limit or extend the range of motion of the user during the exercise. Preferably, the vertically extending walls 32, 34 and 36, 38 of each of the first and second base portions 24, 26 includes pairs of aligned and vertically extending slots 48, 50 formed therein. Slots 48, 50 are shaped and configured to receive corresponding adjustable stops 45, 47. For example, adjustable stops 45, 47 can be an elongated cylindrical rod that when disposed in the associated slot halts the motion of the user's torso during an exercise, specifically when the user is in the positive or extended position as described in further detail below. Of course, any conventional stop means that can restrict the user's range of motion (e.g., bands anchored adjacent to or on stops 40, 42, adjustable pegs, etc.) may be used. Preferably, the lower or neutral position stops 40, 42 are fixed.

To maintain the position of the base elements during an exercise, the opposed ends 52, 54 and 56, 58 along the longitudinal axes a-aa and b-bb of each base portion 24, 26, respectively, are adjustably fixed using first (positive) and second (neutral) connection devices 59, 61 according to the type of exercise that the user would like to perform. More particularly, first connection device 59 includes connection points 60 and 64 that may be provided at first ends 52, 56 of base portions 24, 26 respectively, to couple a corresponding elongated locking element 68 thereto. For example, locking element 68 could be a strap and the opposed ends of the strap could be buttons, snaps or heavy duty Velcro®. Second connection device 61 is similar and is provided at the opposed, neutral end 52, 56 of first and second base elements 24, 26 that are coupled together with, for example, a strap 70 and appropriate fasteners at connection points 62, 66.

Figure 8A:
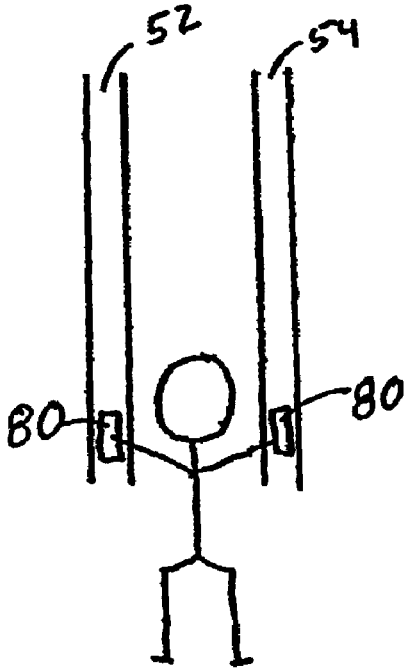
FIG. 8A is a schematic top view of the apparatus of the preferred embodiment, illustrating a user in a neutral position.

With further reference to FIG. 1, the connection devices 59, 61 at the opposed ends 52, 54 and 56, 58 of first and second base portions 24, 26 maintain a generally parallel relationship between portions 24, 26, whereby the user's arms extend outwardly forwardly, generally in-line or parallel with the central longitudinal axis of the user's torso during the exercise. This is shown schematically in FIGS. 8A and 8B, which are described in further detail below. Notably, positive and neutral connection devices 59, 61 may be adjusted to adjust the angular position of the first and second base portions. By doing so, different muscle groups can be worked by the user. This is shown schematically in FIGS. 9A and 9B, which are described in further detail below.

Figure 2:
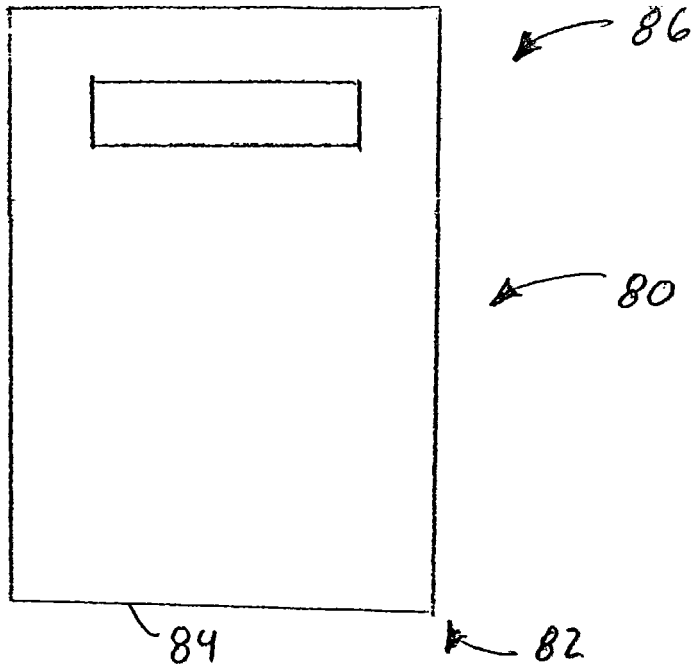
FIG. 2 is a cross-sectional front elevational view of a hand-held sliding device and a base according to a first embodiment of the present invention.
Figure 2:
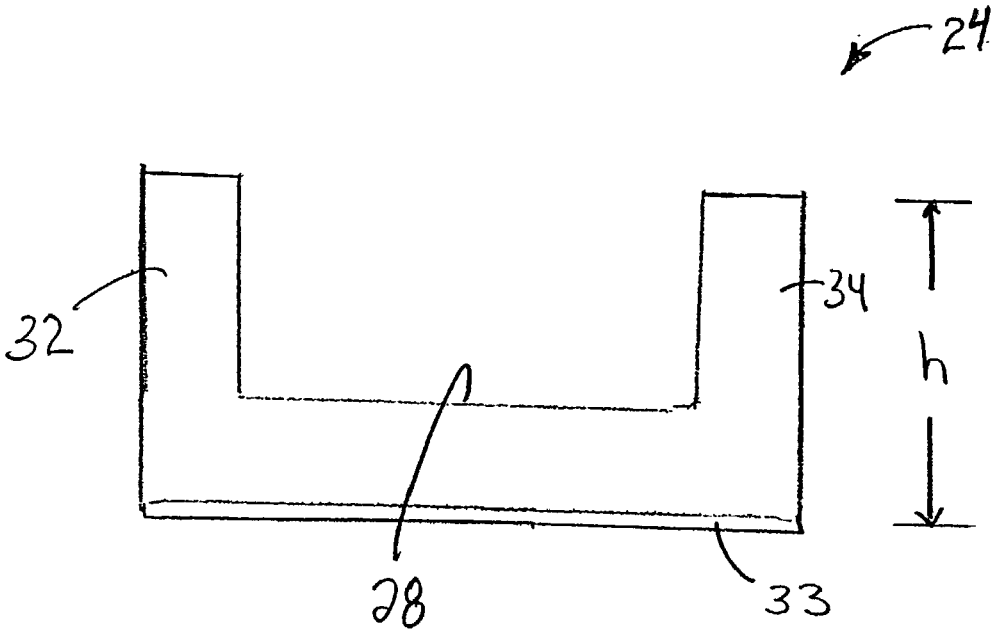
Figure 3:
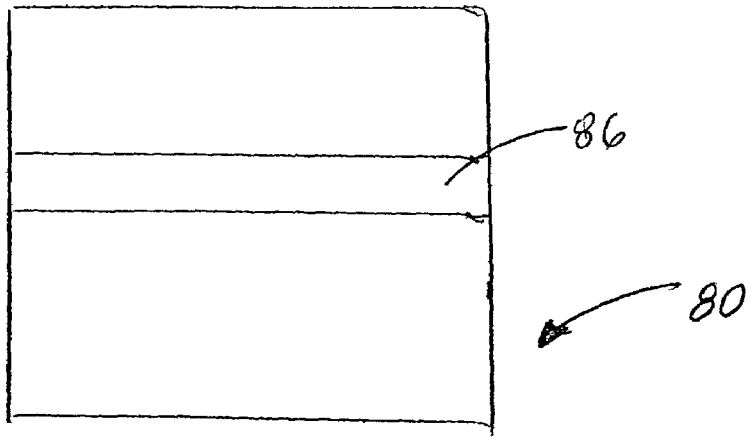
FIG. 3 is a top plan view of the hand-held sliding device shown in FIG. 2.

Turning to FIG. 2, exercise apparatus 20 is shown in cross-section. In particular, base portion 24 having vertically extending sidewalls 32, 34 is adapted to receive a generally square shaped hand-held device 80. Hand-held device 80 includes a contact end 82 having a sliding surface 84 that is configured to interface with sliding surface 28 of base portion 24. Notably, to facilitate smooth operation, walls 32, 34 preferably have an optimized height "h" that permits relative movement while preventing "tipping" of the hand-held devices, yet is not so high as to impede sliding movement. To facilitate ease of use, hand-held device 80 includes a handle 86, preferably formed integrally with device 80, that allows easy grip by the user. During operation, hand-held device 80 slidably traverses the sliding surface 28 of the base portion 24 as the user's weight is distributed differently on the apparatus to create stress in the target muscles of the user. A top view of the hand-held device 80 is shown in FIG. 3.

It is notable that although base is shown with vertically extending sidewalls 32, 34 to ensure proper sliding movement of slidable hand-held device 80, the sidewalls are not necessary for proper operation. In fact, base portions 24, 26 do not need to be provided at all as long as sliding surface 84 of hand-held device 80 can readily slidably traverse along the support surface employed. For example, a polymer hand-held device 80 having a material such as felt fastened to contact end 82 to permit sliding movement of device 80 relative to, for instance, a linoleum floor support surface. For more novice users, however, base portions are recommended to insure proper form during the exercise.

Figure 4:
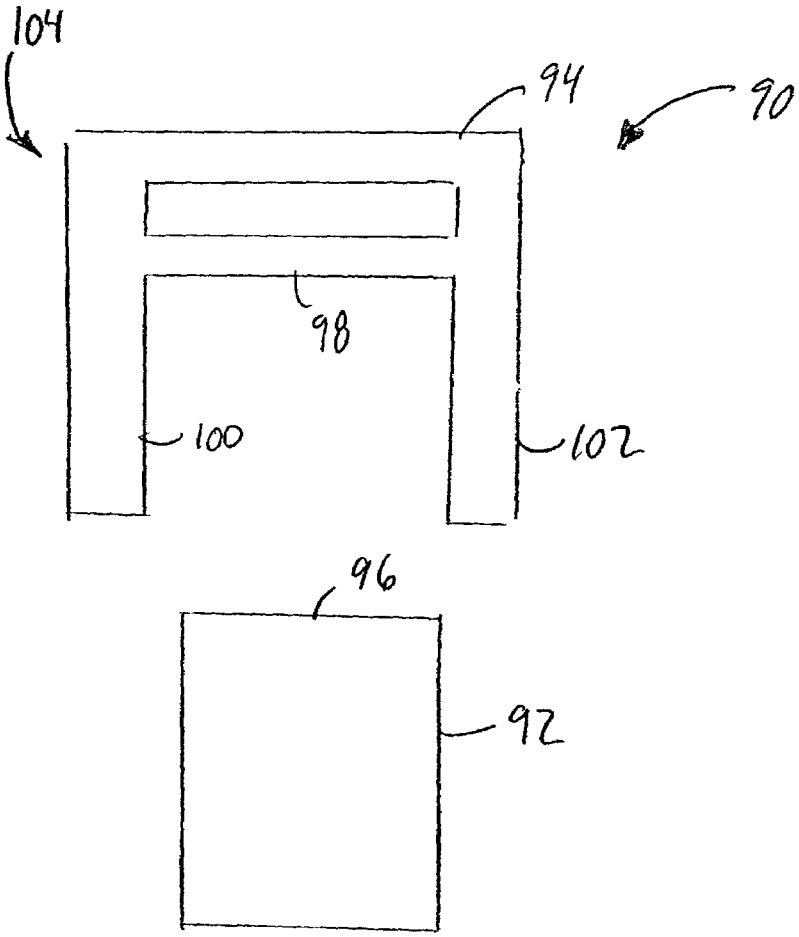
FIG. 4 is a cross-sectional front elevational view of a hand-held sliding device and a corresponding base according to an alternate preferred embodiment.

Turning to FIG. 4, an alternate exercise apparatus 90 that includes an inverted version of the base portion and hand-held sliding device is shown. In particular, a base portion 92 is centrally located in relation to a hand-held sliding device 94 such that it defines a top sliding surface 96 that is adapted to receive a sliding surface 98 of hand-held sliding device 94. Sliding surface 98 is defined, at least in part, by opposed arms 100, 102. As with the embodiment shown in FIG. 2, hand-held sliding device 94 has a handle 104 to allow easy manipulation by the user. As with apparatus 20, hand-held sliding device 94 and corresponding base portions 92 can be made of any suitable material that permits relative sliding motion. Notably, however, the materials should be chosen so that at least some friction impedes the motion between the surfaces. Otherwise, it may be difficult for the user to control sliding device 94 (and device 80 of FIG. 2) during an exercise. For example, bases may be made out of plastic, or other polymer material, and the sliding device of a hand-held device may be made of a similar material such as a polymer material or alternatively be made of an easily slidable material such as felt.

Figure 5:
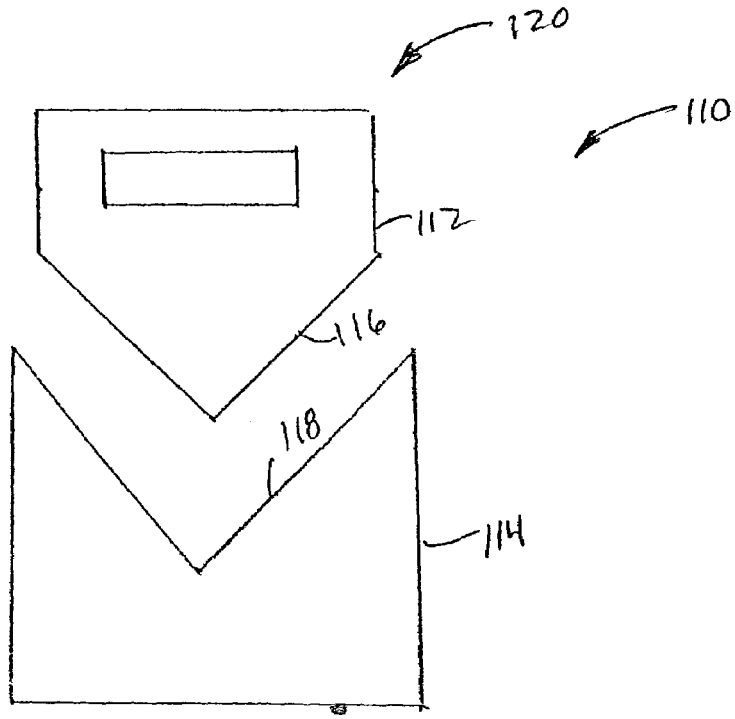
FIG. 5 is a cross-sectional front elevational view of a hand-held sliding device and corresponding base having matable triangular sliding surfaces.
Figure 6:
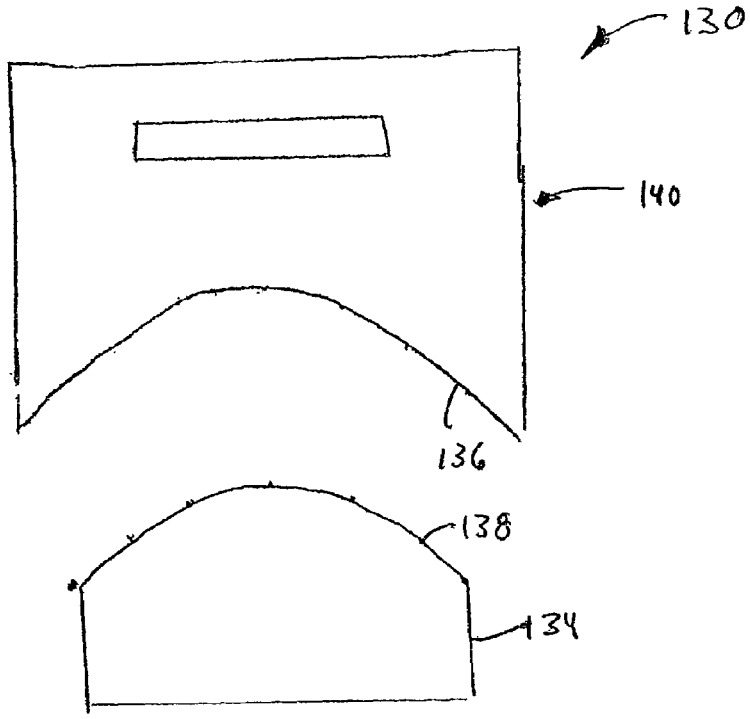
FIG. 6 is a cross-sectional front elevational view of a hand-held sliding device and a corresponding base having matable arcuate sliding surfaces.

Turning to FIGS. 5 and 6, alternate shapes of the hand-held sliding device and the base portions of an exercise apparatus 110 are illustrated. In particular, in FIG. 5, a hand-held sliding device 112 having a handle 120 includes a triangular shape bottom sliding surface 116 and the base portion 114 includes correspondingly shaped triangularly cross-section sidewalls that define sliding surface 118 to receive hand-held slide device 112. In this case, slightly smoother operation may be achieved than when using the embodiment shown in FIG. 3 as the tapered walls may be less restrictive. Turning to FIG. 6, hand-held sliding device 140 and the corresponding base portion 134 are designed similarly to the embodiment shown in FIG. 4; however, arcuate sliding surfaces 136, 138 of exercise apparatus 130 are employed. Although slidability is enhanced, maintaining surface contact is typically more difficult when using this embodiment. Increased concentration is required to maintain surface-to-surface contact, which may be preferred by advanced users to increase work-out intensity.

Figure 7A:
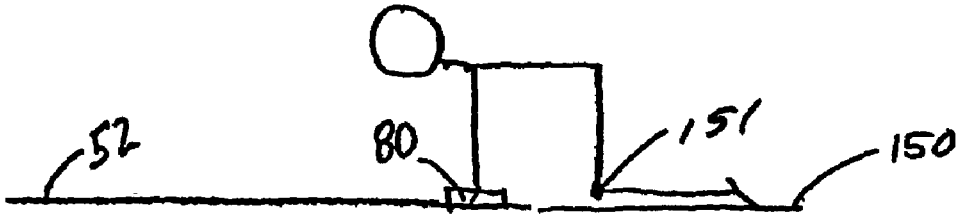
FIG. 7A is a schematic side view of the apparatus of the preferred embodiment, illustrating a user in a neutral position.
Figure 7B:
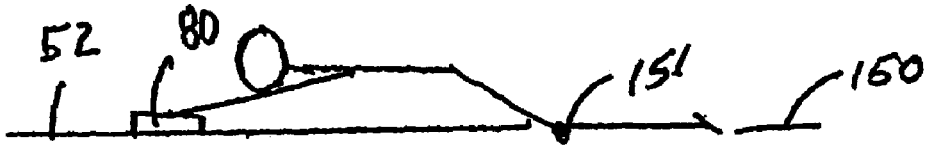
FIG. 7B is a schematic side view of the apparatus of the preferred embodiment, illustrating a user in a positive position.
Figure 8B:
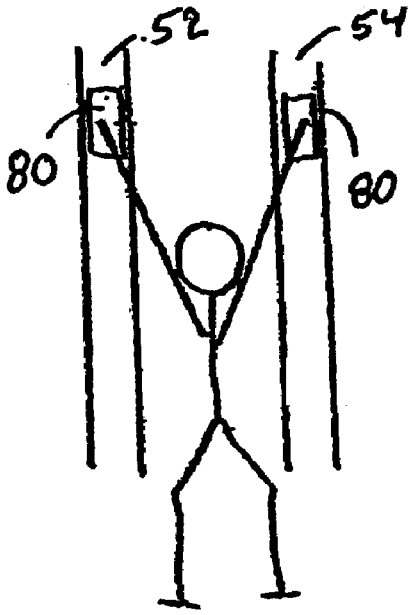
FIG. 8B is a top view of the apparatus of the preferred embodiment, illustrating a user in a positive position.

A schematic illustration of an abdominal workout is shown in FIGS. 7A, 7B, 8A and 8B. The user begins in a neutral position with her knees on the support surface (e.g., the floor) generally in line with the base (or in the case of no base the support surface). In this position, arms are positioned generally orthogonally upwardly to the base as the user readies to perform the exercise. Also, the user's shoulders are preferably generally in-line with the hand-held slide devices 80. In operation, the user extends her arms, maintaining the pivot position 151 of the knees (as shown in FIGS. 7B and 8B), as the user's weight acts to increase strain on the user's muscles, particularly the abdominal muscles in this case. After extending to a desired positive position (as defined, for example, by the adjustable stops 45, 47 shown in FIG. 1), the user returns to the neutral position by pulling back on the hand-held slide devices, while maintaining pivot position 151 as the sliding surfaces of the hand-held slide device and base portions make continuous contact. Most generally, as the user extends to the positive position, the work required by the user increases.

Figure 9A:
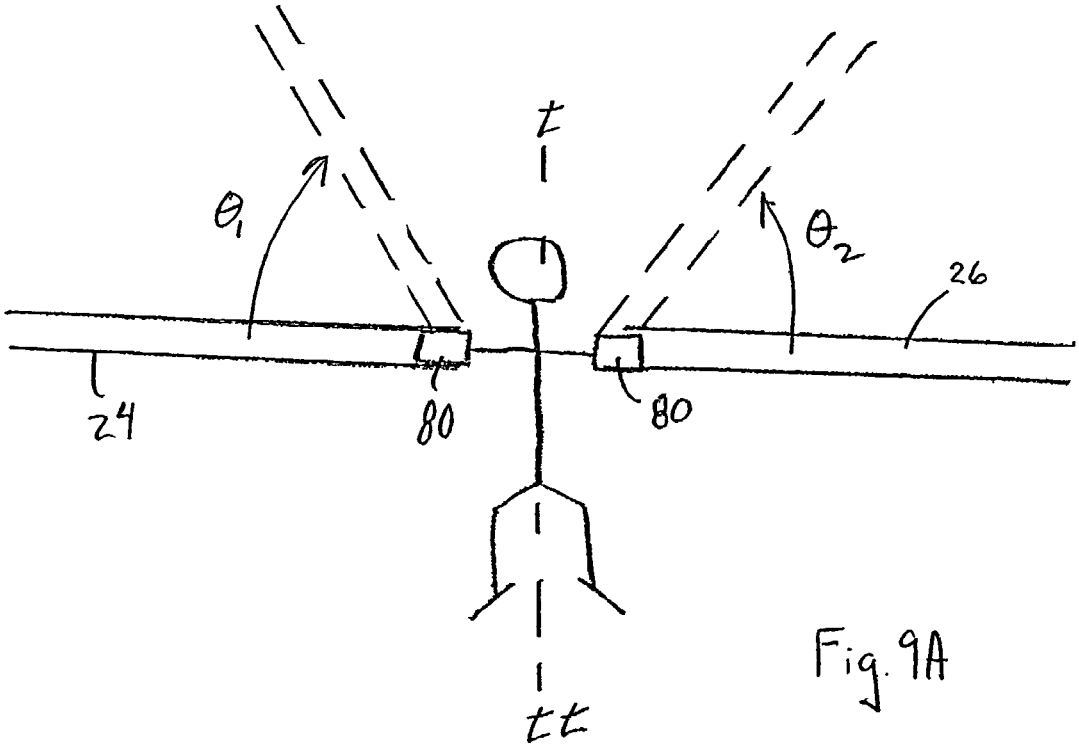
FIG. 9A is a schematic top view of the apparatus of the preferred embodiment in an alternate sliding angle position, illustrating a user in a neutral position.
Figure 9B:
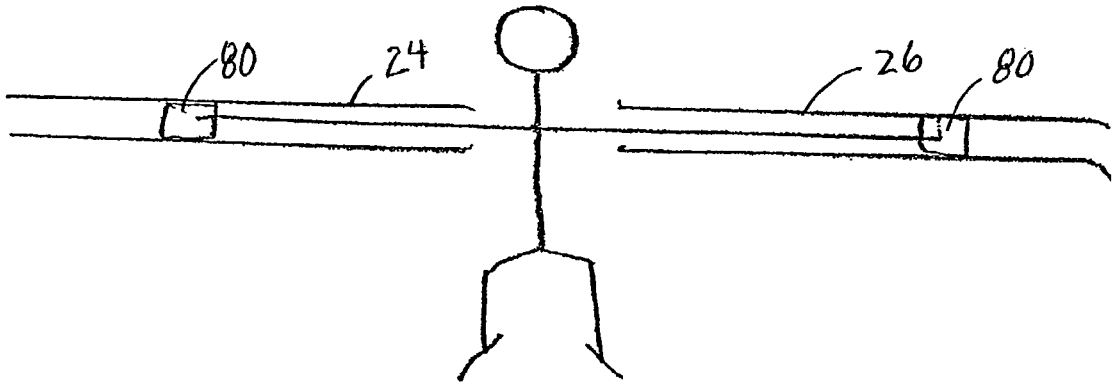
FIG. 9B is a schematic top view of the apparatus of the preferred embodiment in an alternate sliding angle position, illustrating a user in a positive position.

In an alternative exercise, the base portions are positioned at about 180 degrees to each other, as shown in FIGS. 9A and 9B. In this case, connection device 59, and particularly strap 68 (FIG. 1) is disconnected from base portions 24, 26 while base portions 24, 26 are rotated about connection points 62, 66 of the second connection device 61. A neutral position of the user is shown in FIG. 9A where the user's shoulders are generally in-line with sliding devices 80. Then, keeping the knees in a fixed position, the user extends the arms along the first and second base portions 24, 26 as the upper torso is lowered toward the base portions 24, 26. In this case, a chest workout is provided. Of course, any position between this 180° position (and beyond) and the orthogonal position shown in FIG. 1 may be used to work different muscle groups.

More particularly, with reference to FIGS. 1 and 9, neutral connection device 61 is preferably fixed and positive connection device 59 is adjustable so that base portions 24, 26 can be rotated about connection points 62, 66 to adjust sliding angles $\theta_1$ and $\theta_2$. Sliding angles $\theta_1$ and $\theta_2$ are defined by the sliding direction of hand-held devices 80 along longitudinal axes a-aa and b-bb of base portions 24, 26, respectively, relative to the longitudinal axis of locking element 70. By using locking elements 68 of varying length (or a single adjustable locking element 68) apparatus 20 can be fixed according to a selected muscle group to be worked. For the position shown in FIG. 1, where $\theta_1$ and $\theta_2$ are equal to about 90°, the apparatus is particularly useful for developing abdominal muscles. As base portions are rotated outwardly toward $\theta_1$ and $\theta_2$=0°, the user begins to work the chest and back muscles more strenuously. Notably, to prevent movement of base portions relative to the support structure (e.g., the floor, not shown), the surfaces 29, 31 opposite sliding surfaces 28, 30 may be anti-skid surfaces. For example, rubber elements (33, 35) maybe fixed to surfaces 29, 31, or surfaces 29,31 themselves maybe appropriately formed to prevent sliding movement between base portions 24,26 and the support structure.

Figure 10:
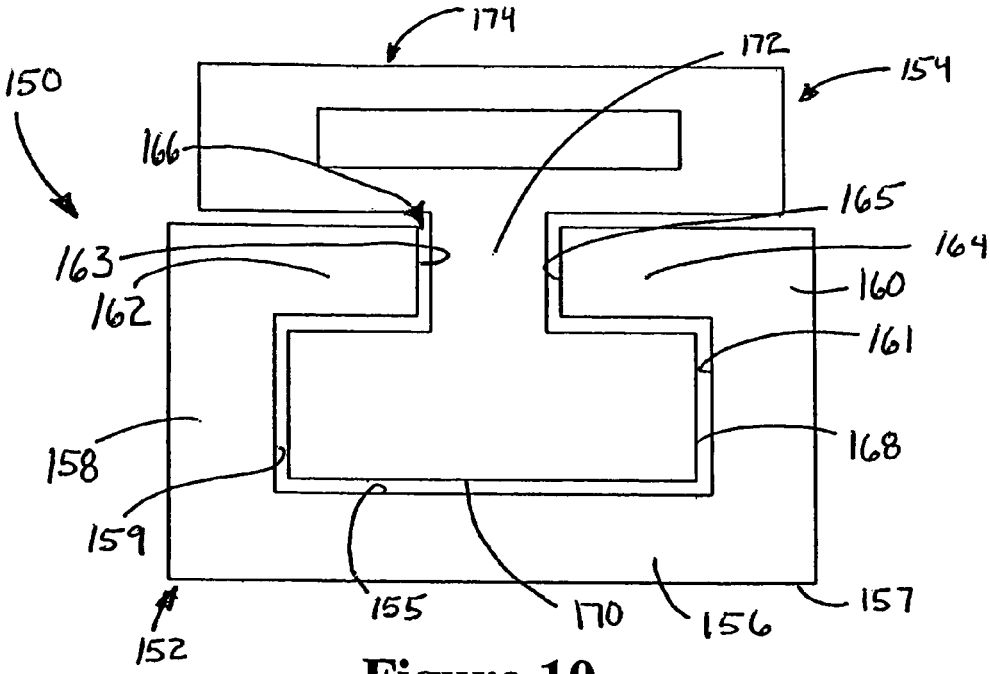
FIG. 10 is a schematic cross-sectional front view of an alternate embodiment of the present invention.
Figure 11:
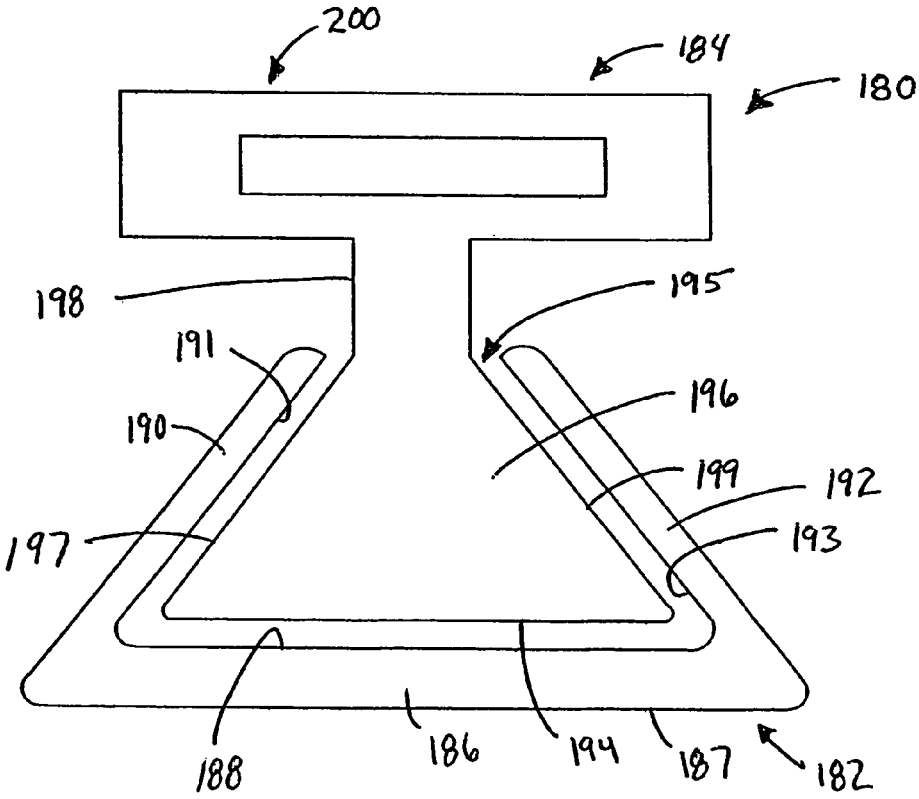
FIG. 11 is a schematic cross-sectional front view of another alternate embodiment of the present invention.

In an alternative to the preferred embodiment described previously, the base portions of the apparatus may be configured to lockably mate with the corresponding hand-held device, as shown in FIGS. 10 and 11. More particularly, as shown in FIG. 10, an exercise apparatus 150 includes a base 152 configured to mate with a hand-held device 154. Base 152 includes an elongated support 156 having a bottom surface 157 adapted to be placed on a corresponding generally flat surface. Notably, surface 157 can be used as support for a non-skid surface, such as a thin layer of rubber (not shown), coupled thereto. Support 156 of base 152 also includes a sliding surface 155 that is adapted to mate with a corresponding sliding surface 170 of hand-held device 154. In this embodiment, base 152 includes generally upwardly extending retaining walls 158, 160 each having a corresponding lip portion 162, 164. Together, lip portions 162, 164 define an opening 166 that accommodates an elongated vertical neck 172 of hand-held device 154. Elongated portion 172 extends generally perpendicularly to support 156 of base 152 and has opposed ends, the first of which supports a block-like structure 168 that defines sliding surface 170.

The opposite end of neck 172 includes a handle 174 for the user to grip during the exercise.

Notably, opening 166 is designed to accommodate neck 172, yet not allow the block-like portion 168 to be withdrawn outwardly from the base portion; rather, the hand-held device 154 in this case must be slidably removed from the base, preferably by removing a detachable abutment (similar to stops 40, 42 shown in FIG. 1) at one end of the base 152. Also, both the sidewalls of neck 172 and structure 168 are preferably designed to slidably mate with the corresponding inner sidewalls 163, 165 and 159, 161 of the lip portions 162, 164 and retaining walls 158, 160, respectively. For instance, the components 152, 154 may be made of a polymer or finished wood characterized as having low friction outer surfaces, with slidability optionally enhanced with an appropriate powder or wax. Overall, walls 158, 160 operate to help the user maintain control over the apparatus during the exercise, which is particularly useful as the user becomes exhausted during use of the apparatus.

In an alternative similar to the embodiment shown in FIG. 10, base 182 of exercise apparatus 180 includes a generally flat and elongated support 186 that includes a bottom surface 187 adapted to be placed on a generally flat support surface such as a floor, optionally provided with an anti-skid surface applied thereto. Support 186 of base 182 also includes a sliding surface 188 adapted to slidably receive a sliding surface 194 of hand-held device 184. Base 182 also includes generally upwardly extending retaining walls 190, 192 that are positioned relative to support 186 of base 182 so that the generally free ends of the walls define an opening 195 that allows a neck 198 of hand-held device 184 to slidably move along base 182. Hand-held device 194 has a correspondingly shaped (in this case, triangular) section 196 that defines slidable surface 194 such that retaining walls 190, 192 operate to retain hand-held device 184 with base 182. Hand-held device 184 also includes a handle 200 to allow the user to grip hand-held device during an exercise movement. Again, similar to the embodiment shown in FIG. 10, hand-held device 184 cannot be pulled apart from base 182 (upwardly, orthogonal to support 186) and must be slidably removed, preferably by removing an abutment placed at one end of the elongated base 182. Moreover, inner surfaces 191, 193 of walls 190, 192 are preferably designed and configured to slidably mate with walls 197, 199 of section 196. For instance, components 182, 184 may be made of a polymer or finished wood characterized as having low friction outer surfaces, with powder or wax optionally disposed thereon to enhance slidability.

Overall, the present invention provides the user with an aerobic or anaerobic exercise that strengthens particular muscles or muscle groups with similar results to prior devices such as free-weights and weight machines that are awkward, uncomfortable and clumsy. Furthermore, in view of the broad range of motion provided by the design, the preferred embodiment allows a user to get a full body workout without having a workout partner. Importantly, the apparatus provides the ability to administer a correct or desired amount of exercise force that can be adapted to the capabilities and fitness goals of the user. And, the apparatus achieves its goals with a relatively inexpensive design that has no moving parts and thus is virtually indestructible and maintenance free.

Although the best mode contemplated by the inventors of carrying out the present invention is disclosed above, practice of the present invention is not limited thereto. For example, although the hand-held sliding devices described are all relatively rigid components defining one or more sliding surfaces and having a separate or integral handle, the hand-held sliding device could be a glove, where the palm of the glove is made of an appropriate material so as to define a sliding surface that is adapted to slide relative to the support sliding surface during an exercise. It will be manifest that various additions, modifications and rearrangements of the features of the present invention may be made without deviating from the spirit and scope of the underlying inventive concept.

What is claimed is:

1. An exercise apparatus comprising:

at least one support defining independent left and right first sliding surfaces;

left and right hand-held sliding devices each defining a corresponding second sliding surface configured to mate with said left and right first sliding surfaces, respectively;

wherein each said second sliding surface slides along said first sliding surface when a user applies a force to said hand-held sliding device; and wherein a position of at least one of said left and right first sliding surfaces is adjustable so as to adjust an exercise sliding angle wherein the point of contact on the surface between the left and right hand held sliding devices and corresponding left and right sliding devices does not substantially change.

2. The exercise apparatus of claim 1, wherein said support is elongated and has a pair of generally parallel sidewalls.

3. The exercise apparatus of claim 1, wherein said support and each said sliding device are lockably mated.

4. The exercise apparatus of claim 3, wherein said support has a pair of generally opposed sidewalls to couple each said sliding device to said support.

5. The exercise apparatus of claim 4, wherein each said sliding device includes a neck, and said sidewalls each include a lip extending generally parallel to said corresponding first sliding surface, said lips defining an opening that accommodates said neck.

6. The exercise apparatus of claim 1, wherein each of said first and second sliding surfaces is triangular.

7. The exercise apparatus of claim 1, wherein each of said first and second sliding surfaces is arcuate.

8. The exercise apparatus of claim 1, further comprising a stop coupled to said support and positioned generally orthogonally to a sliding direction.

9. The exercise apparatus of claim 8, wherein said stop is adjustable.

10. The exercise apparatus of claim 1, wherein first and second connection devices are used to releasably couple corresponding opposed ends of said left and right first sliding surfaces.

11. The exercise apparatus of claim 10, wherein a position of said support relative to one of said first and second connection devices is adjustable so as to adjust the sliding angle.

12. The exercise apparatus of claim 11, wherein the sliding angle is adjustable from about 0 degrees to 90 degrees relative to a longitudinal axis of at least one of said connection devices.

13. The exercise apparatus of claim 1, wherein said second sliding surface includes felt.

14. An exercise apparatus comprising:

at least one support defining independent left and right first sliding surfaces;

left and right hand-held sliding devices each defining a corresponding second sliding surface configured to mate with said left and right first sliding surfaces, respectively;

wherein each said second sliding surface slides along said first sliding surface when a user applies a force to said hand-held sliding device;

wherein a position of at least one of said left and right first sliding surfaces is adjustable so as to adjust an exercise sliding angle; and wherein said hand-held sliding device is a glove.

15. An exercise apparatus supported by independent left and right first sliding surfaces, the apparatus comprising:

at least one hand-held sliding device defining a second sliding surface configured to mate with at least one of said first sliding surfaces; and wherein said second sliding surface slides along said first sliding surface when a user applies body weight on said hand-held sliding device; and wherein said left and right first sliding surfaces are configured to be positionable so as to adjust an exercise sliding angle wherein the point of contact on the surface between the left and right hand held sliding devices and corresponding left and right sliding devices does not substantially change.

16. The exercise apparatus of claim 15, wherein the first sliding surface is defined by a support, said support being elongated.

17. The exercise apparatus of claim 16, further defining a stop coupled to said support and positioned generally orthogonally to a sliding direction.

18. The exercise apparatus of claim 17, wherein said stop is adjustable.

19. The exercise apparatus of claim 15, wherein the left and right first sliding surfaces are releasably coupled at at least one connection point; and wherein at least one of the left and right first sliding surfaces is rotatable about the connection point to change the exercise sliding angle.

20. The exercise apparatus of claim 1, wherein the exercise sliding angle is chosen so the user works a selected muscle or group of muscles.

21. The exercise apparatus of claim 1, wherein said hand-held sliding devices are portable and include no moving parts.

22. The exercise apparatus of claim 1, wherein a load that the user works against is provided substantially only by gravity operating on the user's body weight.

* * * * *